US008490960B2

(12) United States Patent
Murata et al.

(10) Patent No.: US 8,490,960 B2
(45) Date of Patent: Jul. 23, 2013

(54) SHEET PROCESSING APPARATUS AND IMAGE FORMING SYSTEM

(75) Inventors: Kazuya Murata, Aichi (JP); Mitsuru Ichikawa, Aichi (JP); Toshikazu Sato, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/369,355

(22) Filed: Feb. 9, 2012

(65) Prior Publication Data

US 2012/0220440 A1 Aug. 30, 2012

(30) Foreign Application Priority Data

Feb. 24, 2011 (JP) ..... 2011-038691

(51) Int. Cl.
*B65H 37/06* (2006.01)

(52) U.S. Cl.
USPC ..... 270/45; 270/32; 493/424; 493/417; 493/445

(58) Field of Classification Search
USPC ..... 270/32, 45, 46; 493/417, 424, 442, 493/443, 444, 445
See application file for complete search history.

(56) References Cited

U.S. PATENT DOCUMENTS

| | | | | |
|---|---|---|---|---|
| 6,251,054 | B1 * | 6/2001 | Cruz et al. | 493/383 |
| 7,597,311 | B2 * | 10/2009 | Kawata et al. | 270/37 |
| 7,712,732 | B2 * | 5/2010 | Horii et al. | 270/32 |
| 8,062,201 | B2 * | 11/2011 | Mimura et al. | 493/434 |
| 2009/0062100 | A1 | 3/2009 | Takekawa et al. | |
| 2009/0129840 | A1 | 5/2009 | Takekawa et al. | |
| 2010/0252981 | A1 | 10/2010 | Kimata et al. | |
| 2010/0284720 | A1 | 11/2010 | Hayashi | |
| 2010/0304947 | A1 | 12/2010 | Itou | |
| 2011/0058876 | A1 * | 3/2011 | Yasuda et al. | 399/407 |
| 2011/0101591 | A1 * | 5/2011 | Sano et al. | 270/20.1 |
| 2011/0101593 | A1 * | 5/2011 | Imazu et al. | 270/45 |
| 2011/0190109 | A1 | 8/2011 | Kimata | |
| 2011/0190110 | A1 | 8/2011 | Honda | |
| 2011/0212817 | A1 * | 9/2011 | Imazu et al. | 493/442 |
| 2011/0221125 | A1 | 9/2011 | Kimata | |
| 2012/0071310 | A1 * | 3/2012 | Satoh | 493/442 |

FOREIGN PATENT DOCUMENTS

| | | | |
|---|---|---|---|
| JP | 4238193 | A | 12/2008 |
| JP | 4425101 | B2 | 12/2009 |
| JP | 2012121686 | A * | 6/2012 |

OTHER PUBLICATIONS

English Language abstract for Patent Publication No. JP-2006-001736 Corresponds to JP-4238193.
English language abstract for patent publication No. JP-2006-076776 coresponds to JP-4425101.

* cited by examiner

*Primary Examiner* — Patrick Mackey
(74) *Attorney, Agent, or Firm* — Harness, Dickey & Pierce, P.L.C.

(57) ABSTRACT

A sheet processing apparatus is provided with a conveying path forming member that forms a sheet conveying path having a curved portion through which a front edge of the sheet passes, a sheet conveying unit that conveys the sheet along the sheet conveying path, a sheet folding unit that folds the sheet along the folding line in the sheet conveying path, and then conveys the sheet toward a discharge direction with the folding line discharged first as a front edge, and a sheet position defining unit that defines a position of the front edge of the sheet in the curved portion of the sheet conveying path so that a target position of the folding line on the sheet coincides with a folding position of the sheet folding unit. The sheet position defining unit can adjust an inclination of the front edge of the sheet.

12 Claims, 15 Drawing Sheets

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2011-038691 filed in Japan on Feb. 24, 2011.

BACKGROUND OF THE INVENTION

1. Field of the Invention

The present invention relates to a sheet processing apparatus that performs a sheet folding process and an image forming system including the same.

2. Description of the Related Art

Conventionally, sheet processing apparatuses, which perform various post processing on a sheet on which an image is formed, have been proposed as auxiliary apparatuses of image forming apparatuses. Here, the "post processing" refers to various kinds of processing such as sorting sheets into a given number of copies, binding sheets using staples, folding sheets in a half-fold form, a tri-fold form (a z-fold form), or in other forms, and punching holes for filing. Of these sheet processing apparatuses, as a sheet processing apparatus (a sheet folding apparatus) that performs a sheet folding process, there has been known an apparatus that bends a sheet by brining the sheet into contact with a stopper and causing folding rollers to nip the bended sheet to form a folding line in a sheet (that is, performs a folding process on a sheet). In the folding system that forms the folding line on the sheet in a manner of nipping the sheet with the folding rollers, it is very important and strongly requested by users that a direction of the folding line is parallel to the front edge of the sheet, that is, that the folding line does not deviate to be oblique to the front edge of the sheet. In the following description, a state in which the folding line deviates to be oblique to the edge of the front edge of the sheet is referred to as "oblique deviation" of the folding line. For example, it is likely that the oblique folding line of the sheet is generated when the size of a sheet as a processing target changes or when a folding type or a folding mode of a sheet changes.

Japanese Patent No. 4238193 discloses a sheet folding apparatus capable of correcting oblique deviation of a sheet. The sheet folding apparatus includes a folding plate that is arranged to move forward or backward in a direction substantially perpendicular to a sheet conveying path, and an angle changing unit that changes a relative angle between an arbitrary edge of a sheet and a folding line and that is arranged on a tail edge fence on which a front edge of a sheet linearly conveyed along the conveying path abuts.

Further, Japanese Patent No. 4425101 discloses a sheet processing apparatus including a configuration that a pair of conveying rollers rotatable clockwise and counterclockwise is disposed downstream of a first folding roller in the sheet conveying direction; the pair of conveying rollers is stopped at a predetermined timing in order to nip a predetermined position of a sheet therebetween, and thereby to determine the sheet folding position. The apparatus further includes a configuration that an abut stopper is disposed upstream of a second folding roller; a front edge of the sheet is abut on the abut stopper so that a tail edge of the sheet is guided to the second folding roll, and thereby the sheet folding position can be determined.

In recent years, there have been market needs for compact and small products, including a need for slim product. In order to respond to the needs, it is required to reduce a space, in which a sheet folding process is performed, in a sheet processing apparatus.

However, in the conventional sheet processing apparatuses disclosed in Japanese Patent No. 4238193 and Japanese Patent No. 4425101, there is a problem in that it is difficult to correct the oblique deviation of the folding line of the sheet while reducing a space in an apparatus.

In addition, in the sheet processing apparatus that performs the sheet folding process, there is a case in which the position of the folding line relative to the front edge of the sheet is required to be changed. The oblique deviation of the folding line needs to be corrected even when the position of the folding line of the sheet is changed.

SUMMARY OF THE INVENTION

It is an object of the present invention to at least partially solve the problems in the conventional technology.

A sheet processing apparatus capable of folding a sheet along a folding line is provides with a conveying path forming member that forms a sheet conveying path having a curved portion through which a front edge of the sheet passes at a downstream side at least of a sheet conveying direction, a sheet conveying unit that conveys the sheet along the sheet conveying path, a sheet folding unit that folds the sheet along the folding line in the sheet conveying path, and then conveys the sheet toward a discharge direction with the folding line discharged first as a front edge, and a sheet position defining unit that defines a position of the front edge of the sheet at the downstream side of the sheet conveying direction in the curved portion of the sheet conveying path so that a target position of the folding line on the sheet coincides with a folding position of the sheet folding unit. The sheet position defining unit is configured to be capable of adjusting an inclination of the front edge of the sheet in the curved portion of the sheet conveying path.

An image forming system includes an image forming apparatus that forms an image on a sheet, and a sheet processing apparatus capable of folding the sheet along a folding line. The sheet processing apparatus is provided with a conveying path forming member that forms a sheet conveying path having a curved portion through which a front edge of the sheet passes at a downstream side at least of a sheet conveying direction, a sheet conveying unit that conveys the sheet along the sheet conveying path, a sheet folding unit that folds the sheet along the folding line in the sheet conveying path, and then conveys the sheet toward a discharge direction with the folding line discharged first as a front edge, and a sheet position defining unit that defines a position of the front edge of the sheet at the downstream side of the sheet conveying direction in the curved portion of the sheet conveying path so that a target position of the folding line on the sheet coincides with a folding position of the sheet folding unit. The sheet position defining unit is configured to be capable of adjusting an inclination of the front edge of the sheet in the curved portion of the sheet conveying path.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, exemplary embodiments of the invention will be described with reference to the accompanying drawings.

Figure 1:
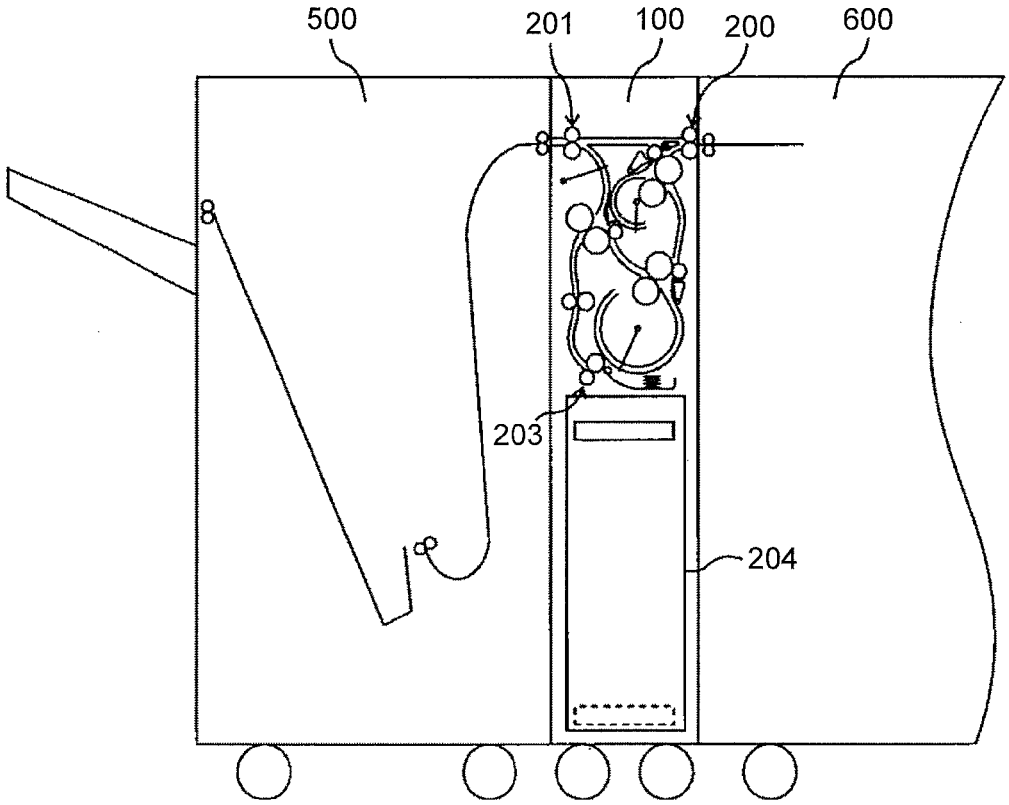
FIG. 1 is a schematic configuration view illustrating a configuration example of an entire image forming system including a sheet folding apparatus according to an embodiment.

FIG. 1 is a schematic view illustrating an exemplary configuration of an entire image forming system including a sheet folding apparatus 100 as a sheet processing apparatus according to an embodiment of the invention. The image forming system of the present embodiment includes the sheet folding apparatus 100, a sheet post processing apparatus 500, and an imaging forming apparatus 600 functioning as an image forming unit. The sheet folding apparatus 100 receives a sheet discharged from the imaging forming apparatus 600, which functions as an upstream apparatus, through an entrance carriage roller 200, and then performs a folding process. The folded sheet may be discharged to a stacker unit 204, which functions as a sheet stacking unit, by a stacker-discharging carriage roller 203, or may be discharged to the sheet post processing apparatus 500 which is a downstream apparatus by a discharging carriage roller 201. Although not illustrated in the exemplary configuration of FIG. 1, a tray as a sheet discharging unit may be provided at a predetermined position of the sheet folding apparatus 100, for example, above the discharging carriage roller 201, so that the sheet is discharged to the tray.

Figure 2:
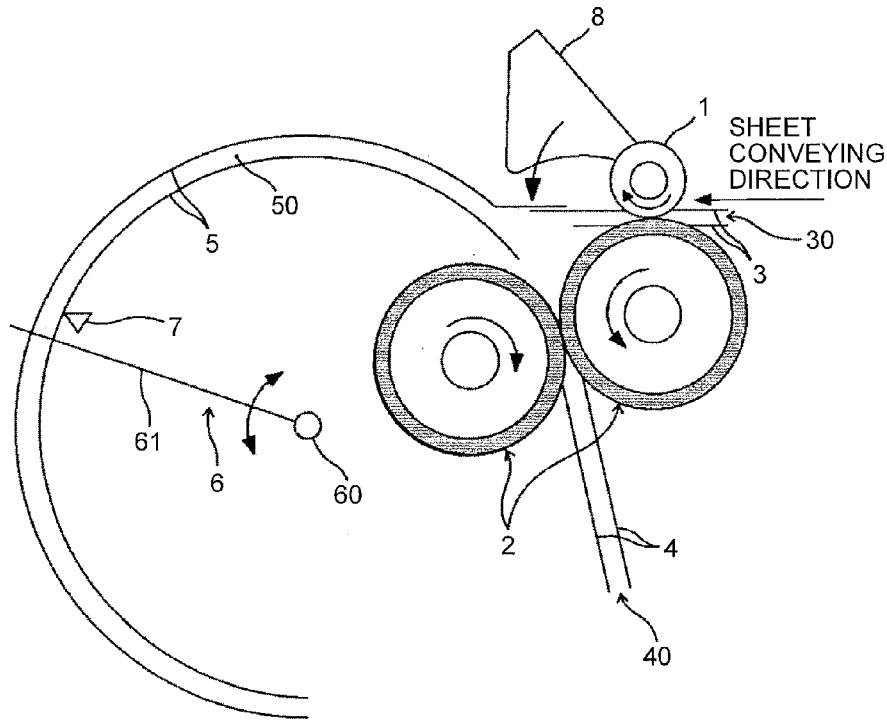
FIG. 2 is a schematic configuration view illustrating a main configuration and a basic operation of the sheet folding apparatus.

FIG. 2 schematic shows a main configuration and a basic operation of the sheet folding apparatus 100.

Referring to FIG. 2, the sheet folding apparatus 100 includes a pair of folding rollers 2 that fold a sheet, a carriage roller 1 functioning as a sheet conveying unit that is driven to rotate by the pair of folding rollers 2 and then conveys a sheet, folding roller driving units (not illustrated) that drive the pair of folding rollers 2, a first conveying path forming member 3 that forms a sheet conveying path 30 through which a sheet is conveyed to the pair of folding rollers 2, and a second conveying path forming member 5 that forms a curved conveying path 50 which is a conveying path for folding the sheet.

The sheet folding apparatus 100 further includes the rotatable sheet position defining member 6 on which a front edge of a sheet abuts, a driving unit (not illustrated) that drives the sheet position defining member 6 to adjust a rotational position of the sheet position defining member 6, a front edge detecting unit 7 that detects a front edge of the sheet, a bending auxiliary member 8 that guides a folding position of a sheet to a nip between the pair of folding rollers 2 on the basis of a signal from the front edge detecting unit 7, and a bending auxiliary member driving unit (not illustrated) that drives the bending auxiliary member 8.

Furthermore, the sheet folding apparatus 100 is configured to include a third conveying path forming member 4 that forms a processed sheet conveying path 40 through which the sheet folded by the pair of folding rollers 2 is conveyed, and a control unit (not illustrated) functioning as a control means that controls the respective driving units on the basis of a signal from the front edge detecting unit 7.

In the sheet folding apparatus 100 of FIG. 2, a sheet conveying path having a curved portion at a downstream side of the sheet conveying direction through which at least a front edge of the sheet is conveyed corresponds to the sheet conveying path 30 at the upstream side (the input side) and the curved conveying path 50 at the downstream side. A conveying path forming member that forms the sheet conveying path is configured with the first conveying path forming member 3 and the second conveying path forming member 5.

As the sheet folding unit for folding a sheet along a folding line in the sheet conveying paths 30 and 50, and then conveying the folded sheet toward a discharge direction with the folding line discharged first as a front edge, there are provided with the pair of folding rollers 2, the third conveying path forming member 4 that forms the processed sheet conveying path 40, the bending auxiliary member 8, and a bending member driving unit which will be described later.

A sheet position defining unit, which defines a position of the front edge of the sheet at the downstream side of the sheet conveying direction in the curved portion (the curved conveying path 50) of the sheet conveying path so that a target line on the sheets to be folded locates accurately at a folding position of the folding unit, is provided with the sheet position defining member 6 and a driving unit of the sheet position defining member 6. The sheet position defining member 6 is provided with a folding position defining shaft 60 which is a driving shaft driven by a driving unit such as a motor, and a rotatable abutting member 61 attached to the folding position defining shaft 60. The folding position defining shaft 60 functions as a shaft that rotates the abutting member 61 to thereby change the abutting position with the front edge of the sheet in the curved conveying path 50 which is the curved portion of the sheet conveying path. The front edge of the sheet conveyed through the curved conveying path 50 abuts on a predetermined sheet abutting surface of the abutting member 61. The sheet position defining member 6 is also called a stopper, since it stops an advance of the sheet by abutting on the front edge of the sheet.

Next, a description will be made in connection with a more concrete configuration example and a basic operation of the sheet folding apparatus 100 having the above configuration.

A sheet as a processing target is conveyed by means of the pair of folding rollers 2 including a driving roller and a following roller, and the carriage roller 1 adjacent to the driving roller of the pair rollers 2. As the driving source of the folding rollers 2, a rotational driving motor such as DC motor or stepping motor may be used. As the front edge detecting unit 7 for detecting a fact that the front edge of the sheet pass through a predetermined position of the curved conveying path 50, a transmissive sensor, a reflective sensor and the like may be used. After passed through the predetermined detecting position of the detecting unit 7, the sheet abuts on the sheet position defining member 6 which serves as the folding position defining unit and block the curved conveying path 50. The sheet starts to be bent in the vicinity of and before folding rollers 2 by an operation that the carriage roller 1 keeps conveying the sheet by rotating toward a direction indicated by an arrow in FIG. 2, even after the sheets abuts on the sheet position defining member 6.

The bent portion of the sheet is pressed by the bending auxiliary member 8 at a predetermined timing triggered by the signal detected by the front edge detecting unit 7. The bending auxiliary member 8 rotates counterclockwise so as to press the sheet between the nip defined by the folding rollers 2. As the driving source for the bending auxiliary member 8, a solenoid or a stepping motor may be used, for example. After the sheet is pressed between the nip defined by the folding rollers 2, the bending auxiliary member 8 rotates clockwise to return to the original position.

The rotation of the sheet position defining member 6 is controlled so as to define or determine the abutting position with the sheet depending on the sheet size or the folding type (the folding mode). A stepping motor that can be controlled only by a pulse (so-called "open-loop controlled") without using a position sensor is preferably used as a driving source of the rotation of the sheet position defining member 6. The front edge detecting unit 7 is disposed or arranged outside a rotation range of the sheet position defining member 6, since it is difficult to dispose the detecting unit 7 in accordance with the position of the front edge stopper which varies depending on the sheet size and/or the folding type (folding mode). Abutting timing of the sheet position defining member 6 can be calculated from a conveying distance of a sheet between the front edge detecting unit 7 and the sheet position defining member 6 and a linear velocity of the sheet (the sheet conveying velocity). The folded sheet that has passed through the pair of folding rollers 2 is fed to the processed sheet conveying path 40 located downstream in the sheet conveying path, by the pair of folding rollers 2.

Figure 3:
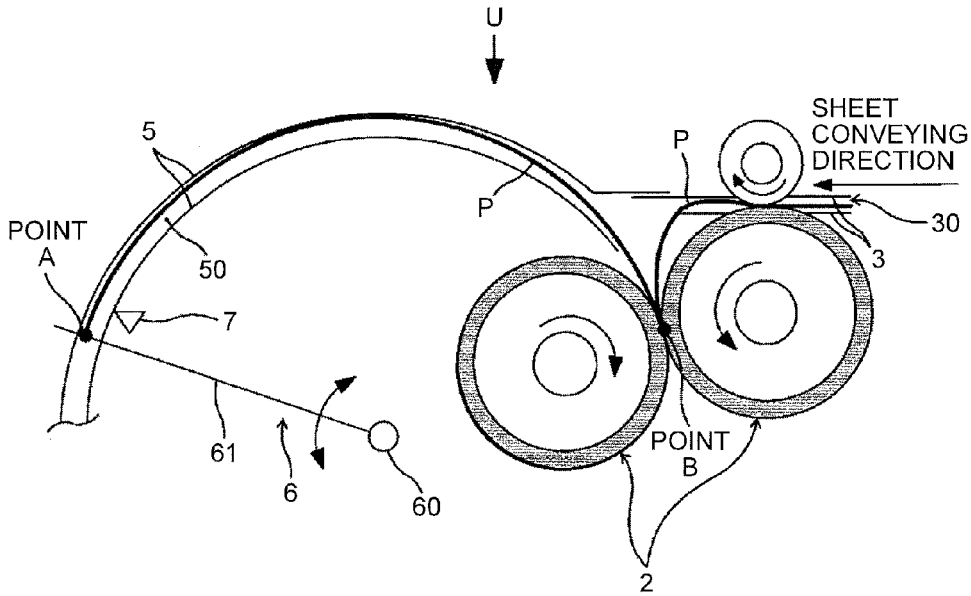
FIG. 3 is a schematic configuration view illustrating a main configuration of the sheet folding apparatus for explaining a cause of oblique deviation of a folding line of a sheet.
Figure 4:
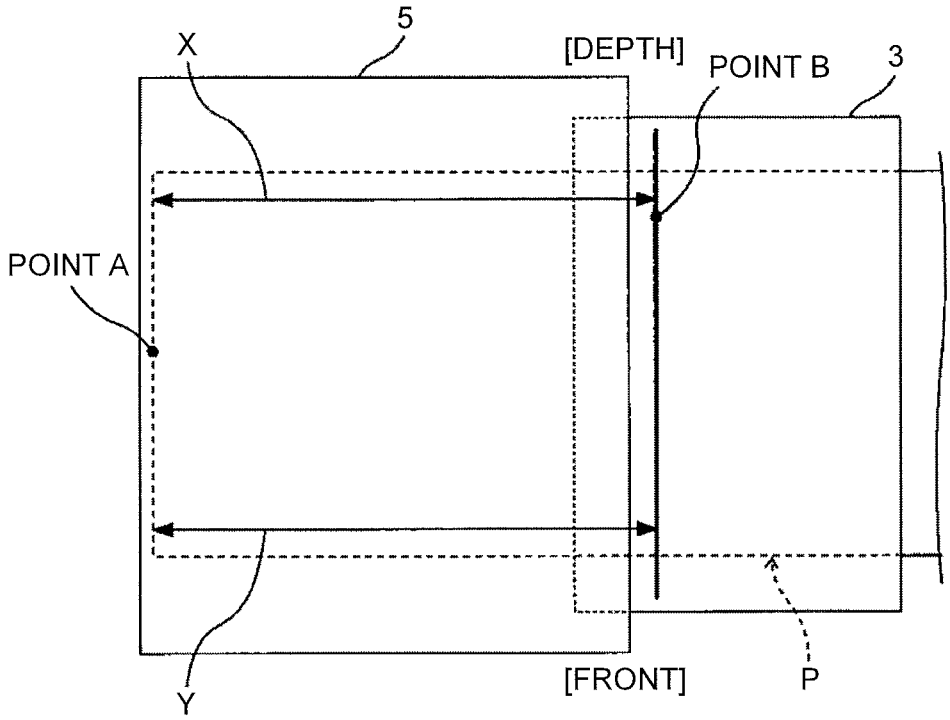
FIG. 4 is an explanatory view illustrating a curved conveying path of FIG. 3 as seen from the upper direction (from a direction indicated by an arrow U)

FIGS. 3 and 4 are explanatory views illustrating the cause of oblique deviation of a folding line of a sheet.

FIG. 3 shows schematically a main configuration of the sheet folding apparatus 100. Referring to FIG. 3, a folding line or folding position of the sheet P is determined on the basis of a length between the point A where the sheet position defining member 6 locates and the point B where the nip is formed by the folding rollers 2. Specifically, the length between A and B becomes shorter if the sheet position defining member 6 rotates counterclockwise from a position illustrated in FIG. 3. On the other hand, the length between A and B becomes longer, if the sheet position defining member 6 rotates clockwise from a position illustrated in FIG. 3.

FIG. 4 shows the curved conveying path 50 of FIG. 3 as seen from the upper direction (from the direction indicated by Arrow U). An upper side and a lower side in FIG. 4 correspond to a depth side and a front side in FIG. 3, respectively. As described above, the folding line or folding position of the sheet P is determined on the basis of the length from the point A of the sheet position defining member 6 to the point B of the nip between the pair of folding rollers 2. Thus, the length AB is the same at both sides of the sheet in the width direction which intersects the sheet conveying direction. Namely, the length X and the length Y at both sides of the sheet P is the same with each other in FIG. 4. However, if the folding position defining shaft 60 of the sheet position defining member 6 is tilted even only a bit because of a misalignment when assembled or an impact when installation, the length X and the length Y at both sides of the sheet P becomes different from each other, despite of inserting the sheet P into the curved conveying path 50 without tilting the sheet. This may be a cause to induce the oblique deviation of the folding line or folding position on the sheet P.

Figure 5A:
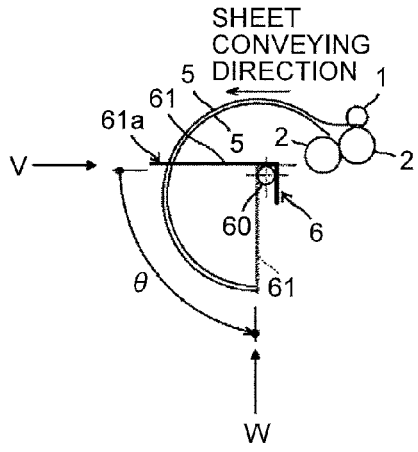
FIG. 5A is a schematic configuration view illustrating a main configuration of the sheet folding apparatus for further explaining the cause of oblique deviation of a folding line of a sheet.
Figure 5B:
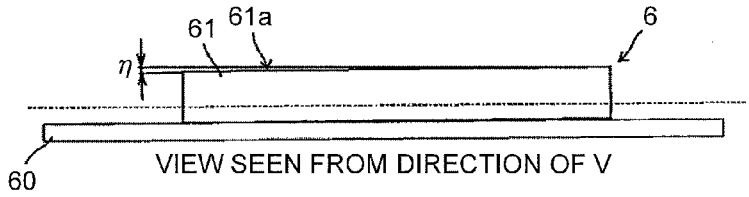
FIGS. 5B and 5C are diagrams seen from a direction indicated by an arrow V in FIG. 5A and from a direction indicated by an arrow W in FIG. 5A, respectively.
Figure 5C:
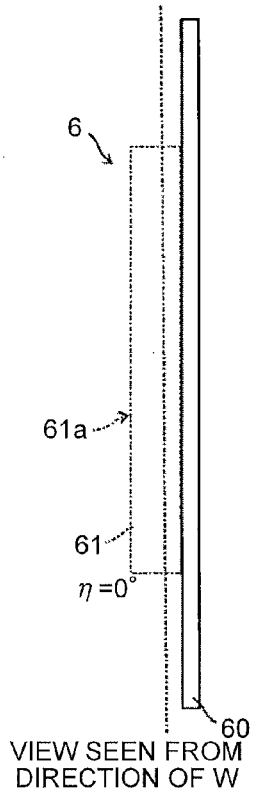
Figure 6:
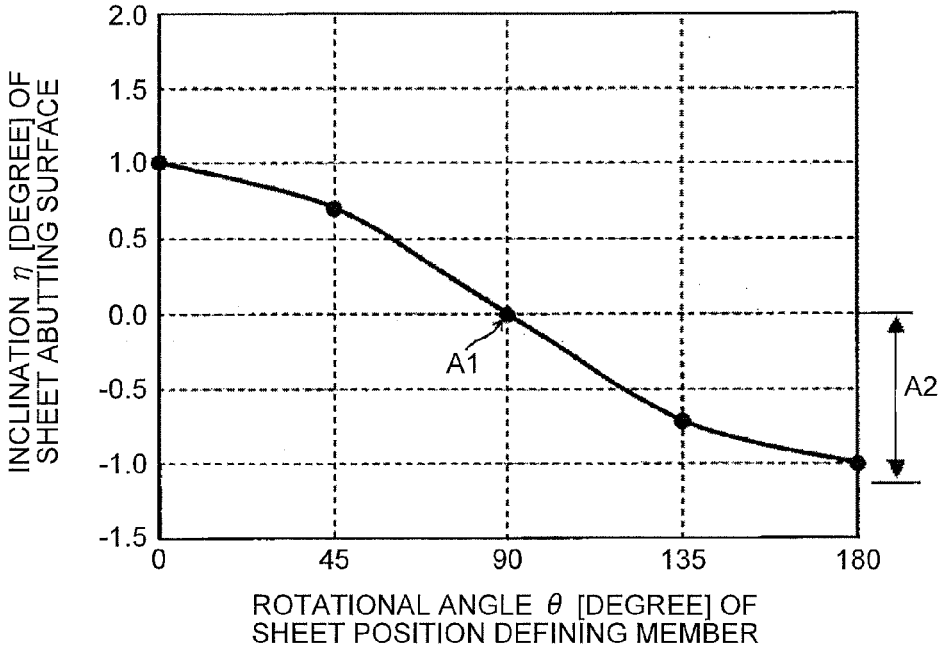
FIG. 6 is a graph illustrating a relation between a rotational angle θ [degree] of a sheet position defining member and an inclined angle η [degree] of a sheet abutting surface with respect to a folding position defining shaft.

FIGS. 5A to 5C and FIG. 6 are explanatory views for further explaining the cause to induce the oblique deviation of the folding line or folding position of the sheet. FIG. 5A shows schematically a main configuration of the sheet folding apparatus 100, and FIGS. 5B and 5C are a diagram as seen from a direction indicated by an arrow V in FIG. 5A and a diagram as seen from a direction indicated by an arrow W in FIG. 5A, respectively. FIG. 6 is a graph illustrating a relation between a rotational angle θ [degree] of the sheet position defining member 6 at which the sheet abuts on and an inclined angle η [degree] of a sheet abutting surface 61*a* with respect to the folding position defining shaft 60 when the folding position defining shaft 60 of the sheet position defining member 6 is inclined by an angle η [degree] with respect to the sheet abutting surface 61*a* of the abutting member 61 attached to the folding position defining shaft 60.

As illustrated in FIGS. 5A to 5C and FIG. 6, the inclined angle (inclination) η of the sheet abutting surface 61*a* periodically changes with respect to the rotational angle θ of the sheet position defining member 6. Since the inclined angle η of the sheet abutting surface 61*a* changes depending on the rotational angle θ of the sheet position defining member 6, for example, even though the oblique deviation of the folding line is corrected on the inclination η (=1 [degree]) of the sheet abutting surface 61*a* when the rotational angle θ of the sheet position defining member 6 is 0 [degree], when the rotational angle θ of the sheet position defining member 6 is 90 [degree], the inclined angle η of the sheet abutting surface 61*a* becomes 0 [degree] as indicated by a point A1 in FIG. 6, and thus a correction effect completely disappears. Further, when the rotational angle θ of the sheet position defining member 6 is larger than 90 [degree] (when θ>90°) as indicated by a range A2 in FIG. 6, the inclined angle η of the sheet abutting surface 61*a* is reversed in polarity, and so the correction is made to thereby worsen the oblique deviation of the folding line. FIGS. 5A to 5C and FIG. 6 have been described in connection with the example in which the oblique deviation of the folding line is corrected when the inclined angle η of the sheet abutting surface 61*a* is 1 [degree]. However, when the rotational angle θ of the sheet position defining member 6 becomes 90°, the inclined angle η of the sheet abutting surface 61*a* (the inclination of the sheet abutting surface 61*a* with respect to the folding position defining shaft 60 of the sheet position defining member 6) becomes 0 [degree], regardless of a value of the inclined angle η of the sheet abutting surface 61*a* when the oblique deviation of the folding line is corrected. Since the position of the folding line of the sheet changes depending on the sheet size or the folding type as described above, when the rotational angle θ of the sheet position defining member 6 of stopping the front edge of the sheet is changed, the inclined angle η of the sheet abutting surface 61*a* is changed, and thus the folding line is obliquely deviated.

In this regard, in the present embodiment, the sheet position defining member 6 functioning as the sheet position defining unit is configured to be able to adjust an inclination of the front edge of the sheet in the curved conveying path 50 so that the oblique deviation of the folding line can be corrected even when the position of the folding line of the sheet changes depending on the sheet size or the folding type.

Figure 7:
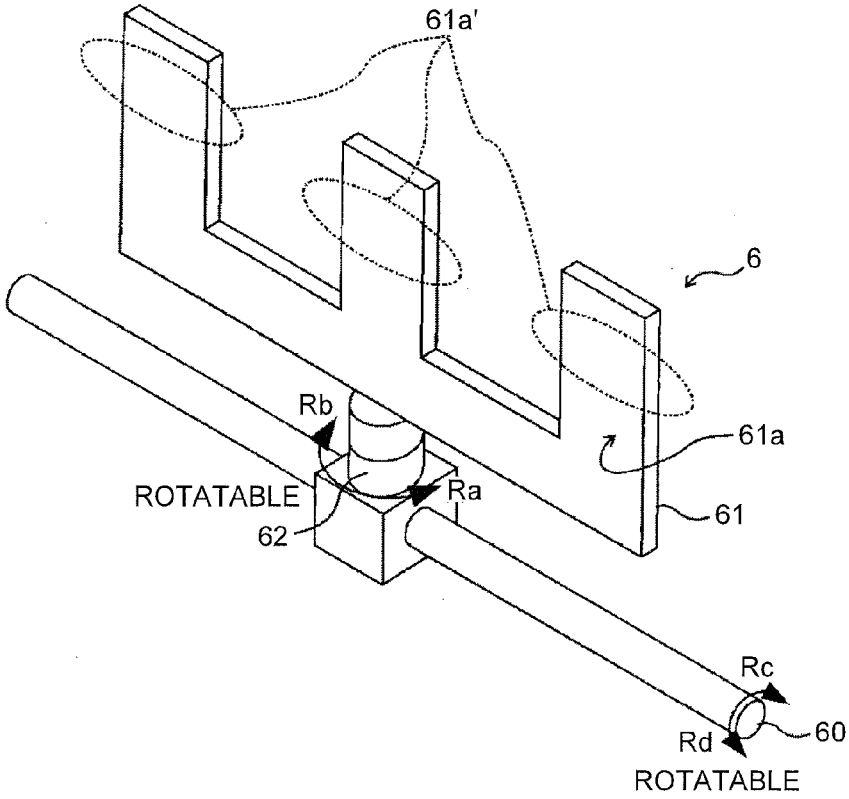
FIG. 7 is a perspective view illustrating a configuration example of the sheet position defining member in a sheet folding apparatus according to the present embodiment.
Figure 8:
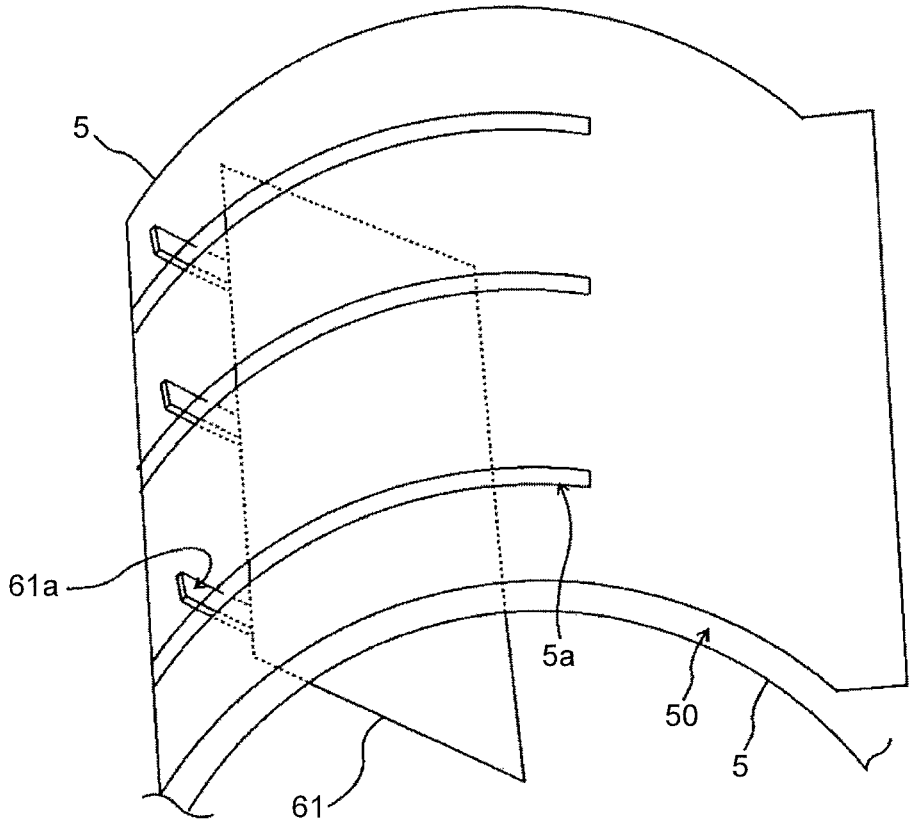
FIG. 8 is a partially enlarged perspective view illustrating a relation between a curved conveying path and a sheet position defining member.

FIG. 7 is a perspective view illustrating a configuration example of the sheet position defining member 6 in the sheet folding apparatus 100 according to the present embodiment. FIG. 8 is a partially enlarged perspective view illustrating a relation between the curved conveying path 50 and the sheet position defining member 6.

As illustrated in FIG. 7, the sheet position defining member 6 has a dual shaft structure provided with not only the folding position defining shaft 60 which is a rotating shaft for rotating in directions indicated by an arrow Rc, Rd in order to change the position of the stopper depending on the sheet size or the folding type, but also a folding deviation correcting shaft 62 as a sheet inclination correcting shaft which is a rotating shaft for rotating in directions indicated by an arrow Ra, Rb in order to correct the folding deviation by adjusting an angle at which the sheet abuts on the sheet position defining member 6.

Further, as illustrated in FIG. 8, the abutting member 61 of the sheet position defining member 6 has a comb shape whose front edge portion is divided into a plurality of sheet abutting portions (3 sheet abutting portions in the example of FIG. 8). The abutting member 61 of the sheet position defining member 6 is configured so that each sheet abutting portion can move in a state that it has penetrated a through hole 5*a* formed in the conveying path forming member 5 along the sheet conveying direction.

In FIGS. 7 and 8, when the sheet moves along the curved conveying path 50, the sheets abuts on sheet abutting portions 61*a*' (portions indicated by alternate long and short dash lines in FIG. 7) on the sheet abutting surface 61*a* of the abutting member 6. The folding deviation correcting shaft 62 can be adjusted when it is shipped from a factory or when it is installed the user's place. However, in this case, since the folding deviation correcting shaft 62 is adjusted only at any one specific position on the curved conveying path 50, the folding deviation may occur at a position other than the specific position. In the present embodiment, the folding deviation correcting shaft 62 is provided as well as the folding position defining shaft 60, and the two shafts 60 and 62 are configured to be driven separately.

Figure 9:
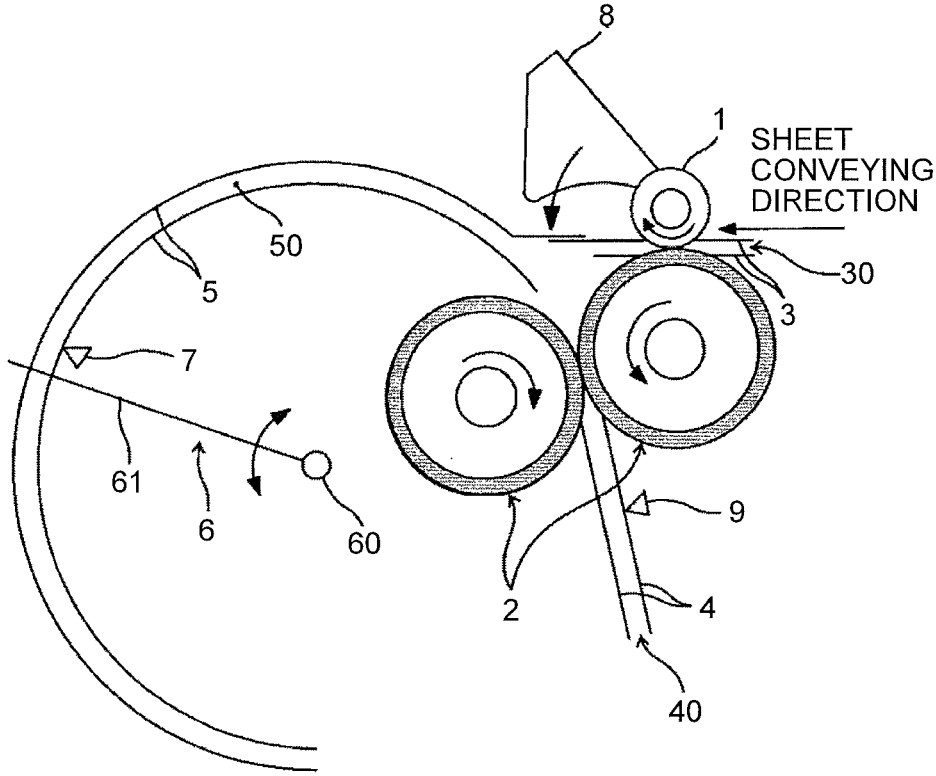
FIG. 9 is a schematic configuration view illustrating a main configuration of the sheet folding apparatus including a folding length measuring unit.
Figure 10:
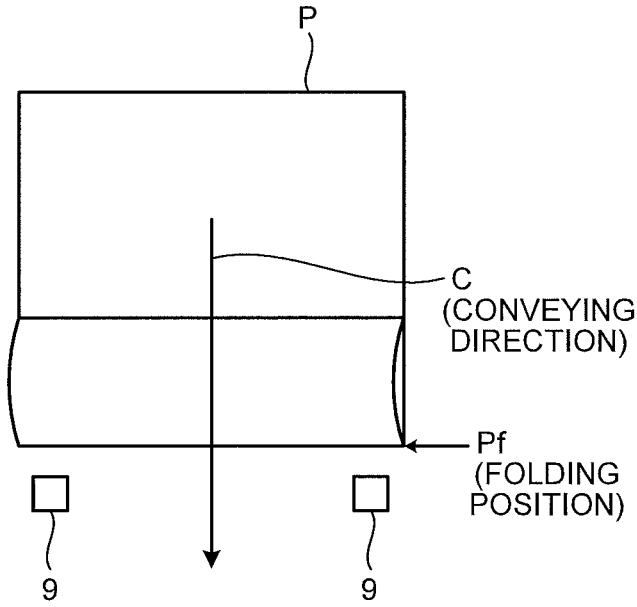
FIG. 10 is an explanatory view illustrating a relation between an arrangement position of a folding length measuring unit and a sheet.

FIG. 9 shows schematically a main configuration of the sheet folding apparatus 100 including a folding length measuring unit 9 that measures a folded sheet that is a processed sheet on which a folding line is formed. FIG. 10 is an explanatory view illustrating a relation between the sheet P and an arrangement position of the folding length measuring unit 9. The folding length measuring unit 9 is a measuring unit that measures a spatial length or a transit time between the folding line (folding position Pf) of the sheet P processed by the sheet folding unit configured with the pair of folding rollers 2, the bending auxiliary member 8 and the like, and the tail edge of the sheet P in a conveying direction C. The folding length measuring unit 9 is provided at each of a plurality of positions (two positions in both end portions in the example of FIG. 10) in the width direction of the processed sheet conveying path 40 through which the folded sheet having passed through the pair of folding rollers 2 is conveyed as illustrated in FIG. 10. For example, a light transmissive sensor or a light reflective sensor may be used as the folding length measuring unit 9.

Figure 11:
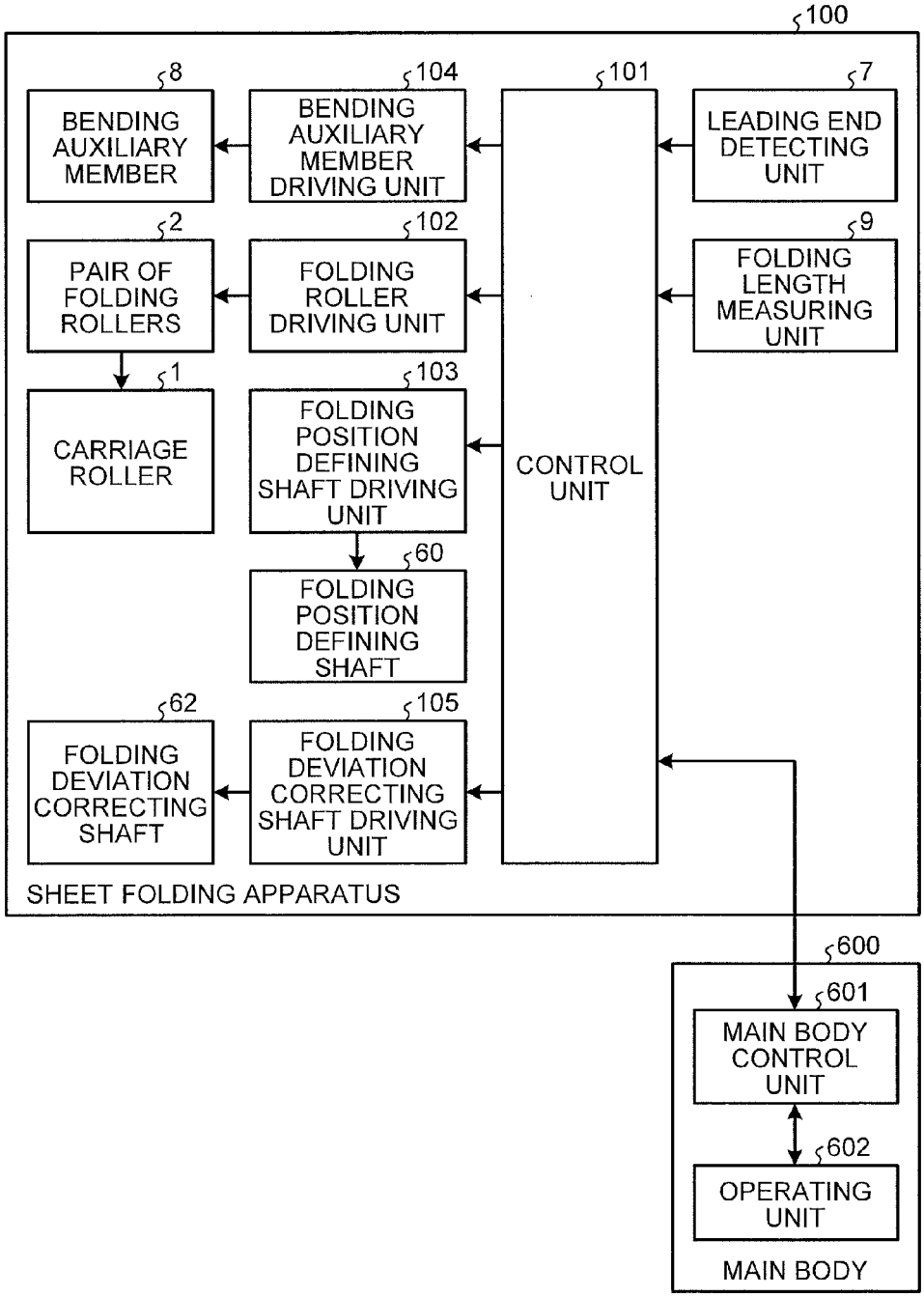
FIG. 11 is a block diagram illustrating a configuration example of a control system in a sheet folding apparatus according to the present embodiment.

FIG. 11 is a block diagram illustrating a configuration example of a control system that performs control on the basis of a measurement result of the folding length measuring unit 9 in the sheet folding apparatus according to the present embodiment. A control unit 101 functioning as a control unit provided in the sheet folding apparatus 100 is configured, for example, with a central processing unit (CPU), a random access memory (RAM), a read only memory (ROM), an input/output (I/O) interface, and the like. The control unit 101 can perform various detecting operations, various measuring operations, various controls, and the like by reading and executing a predetermined program. The control unit 101 is connected to the front edge detecting unit 7 and the folding length measuring unit 9, and may perform control using a detected result of the front edge detecting unit 7 and a measurement result of the folding length measuring unit 9. In addition, the control unit 101 can communicate with a main body of the imaging forming apparatus 600 including an operating unit 602 operated by the user through a main body control unit 601 which is a control unit of the imaging forming apparatus 600. For example, the main body control unit 601 is configured with a CPU, a RAM, a ROM, an I/O interface, and the like, and performs various controls by reading and executing a predetermined program.

The control unit 101 is connected to a folding roller driving unit 102, a folding position defining shaft driving unit 103, a bending auxiliary member driving unit 104, and a folding deviation correcting shaft driving unit 105, and can control the respective driving units. For example, the control unit 101 can control the folding roller driving unit 102 and drive the pair of folding rollers 2 for folding the sheet and the carriage roller 1 that is drivenly rotated by the pair of folding rollers 2 to convey the sheet at predetermined timing. The control unit 101 can control the folding position defining shaft driving unit 103 and adjust the rotational position (the rotational angle) of the folding position defining shaft 60 of the sheet position defining member 6 that abuts on the front edge of the sheet and decides the folding position. Further, the control unit 101 can control the bending auxiliary member driving unit 104 based on a detecting signal of the front edge detecting unit 7 and drive the bending auxiliary member 8 that guides the folding position of the sheet to the nip between the pair of folding rollers 2 at predetermined timing. Furthermore, the control unit 101 can control the folding deviation correcting shaft driving unit 105 based on a measurement signal of the folding length measuring unit 9 and adjust the rotational position (rotational angle) of the folding deviation correcting shaft 62 of the sheet position defining member 6.

Next, a description will be made in connection with an example of a basic operation of the sheet folding apparatus 100 having the configuration illustrated in FIGS. 9 to 11.

A sheet of a processing target is conveyed along the sheet conveying path 30 at the input side and the curved conveying path 50 at the sheet front edge side by the pair of folding rollers 2 functioning as a driving side roller and a driven side roller and the carriage roller 1 (driven) that is adjacent to the folding roller at the driving side. After passing through the detected position of the front edge detecting unit 7 in the curved conveying path 50, the sheet abuts on the sheet position defining member 6 that blocks the curved conveying path 50. Even after the sheet abuts on the sheet position defining member 6, the carriage roller 1 rotates in a direction of an arrow illustrated in FIG. 9 and conveys the sheet, so that the sheet starts to bend nearby the front of the pair of folding rollers 2. A bent portion of the sheet is pressed at specific timing using a detecting signal from the front edge detecting unit 7 as a trigger. The bending auxiliary member 8 rotates counterclockwise to press the sheet into the nip between the pair of folding rollers 2. After the sheet is pressed into the nip between the pair of folding rollers 2, the bending auxiliary member 8 rotates clockwise and then returns to its original position. Here, abutting timing at which the sheet abuts on the sheet position defining member 6 may be calculated based on a sheet conveying distance between the detected position of the front edge detecting unit 7 and the sheet abutting surface of the sheet position defining member 6 and linear velocity (sheet conveying velocity). The folded sheet that has passed through the nip between the pair of folding rollers 2 passes through the measurement positions of the folding length measuring units 9 arranged at two positions in the width direction of the processed sheet conveying path 40 at the downstream side of the pair of folding rollers 2, and so the transit time from when the front edge of the processed sheet is detected (the folding lines is detected) to when the tail edge of the processed sheet is detected is measured. Based on the measurement result of the transit time, the control unit 101 controls the folding deviation correcting shaft driving unit 105 such that the folding deviation correcting shaft 62 is adjusted. The control unit 101 may calculate a spatial length between the front edge (the position of the folding line) and the tail edge of the processed sheet at the two positions in the width direction based on the measurement result of the transit time and the sheet conveying velocity, and controls the folding deviation correcting shaft driving unit 105 based on the calculation result such that the folding deviation correcting shaft 62 is adjusted.

Figure 12A:
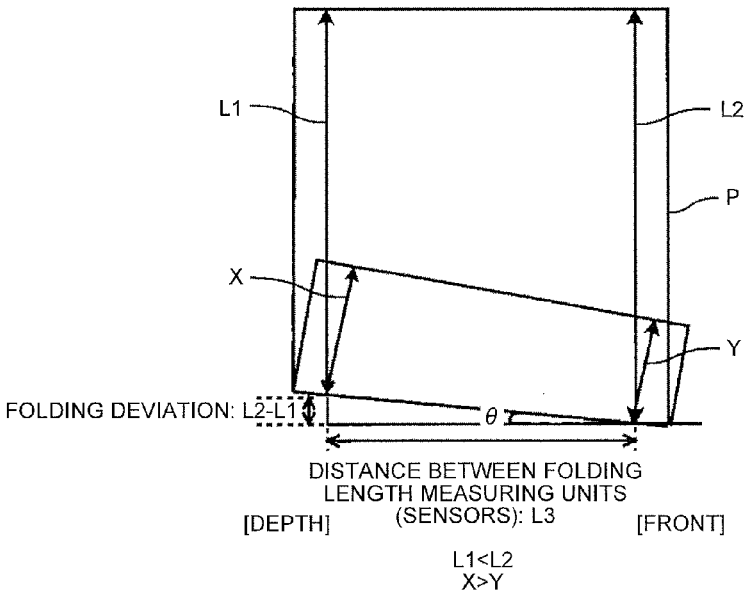
FIGS. 12A and 12B are explanatory views illustrating a method of adjusting oblique deviation in a folding position.
Figure 12B:
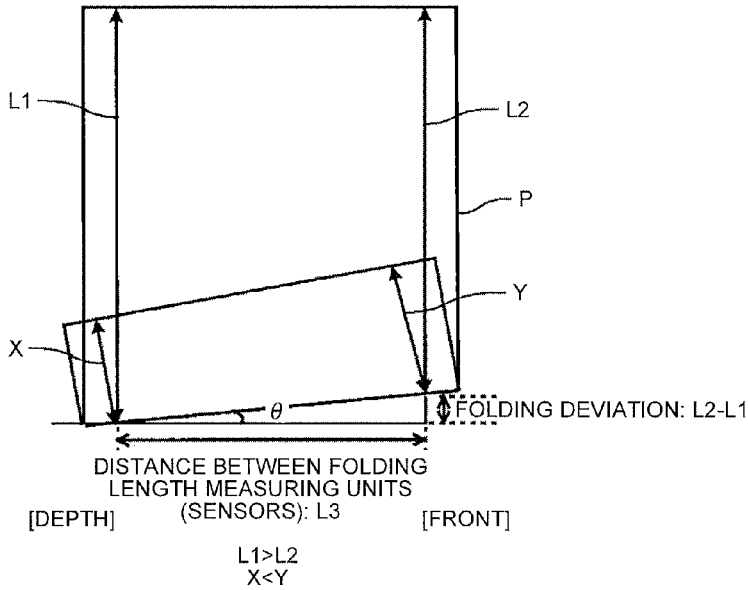

FIGS. 12A and 12B are explanatory views illustrating a method of adjusting oblique deviation in a folding position, and illustrate oblique deviation in a folding position in a folded sheet.

Here, when oblique deviation in a folding position illustrated in FIG. 12A occurs in the folded sheet P, X is larger than Y (L1 is shorter than L2). Since an adjustment for increasing Y (X=Y) is necessary, the folding deviation correcting shaft 62 of the sheet position defining member 6 illustrated in FIG. 7 needs to be adjusted in a direction of an arrow Ra or Rb. An adjustment quantity at this time can be calculated from θ that satisfies the following Formula (1) based on a deviation quantity "L2−L1" and a distance L3 between the plurality of folding length measuring units (sensors) 9 illustrated in FIG. 9.

$$\tan\theta=(L2-L1)/L3 \quad (1)$$

Meanwhile, when oblique deviation in a folding position illustrated in FIG. 12B occurs in the folded sheet P, X is smaller than Y (L1 is longer than L2). Since an adjustment for reducing Y (X=Y) is necessary, the folding deviation correcting shaft 62 of the sheet position defining member 6 illustrated in FIG. 7 needs to be adjusted in a direction reverse to the above case. An adjustment quantity at this time can be calculated using Formula (1) as calculated in the above case.

Figure 13:
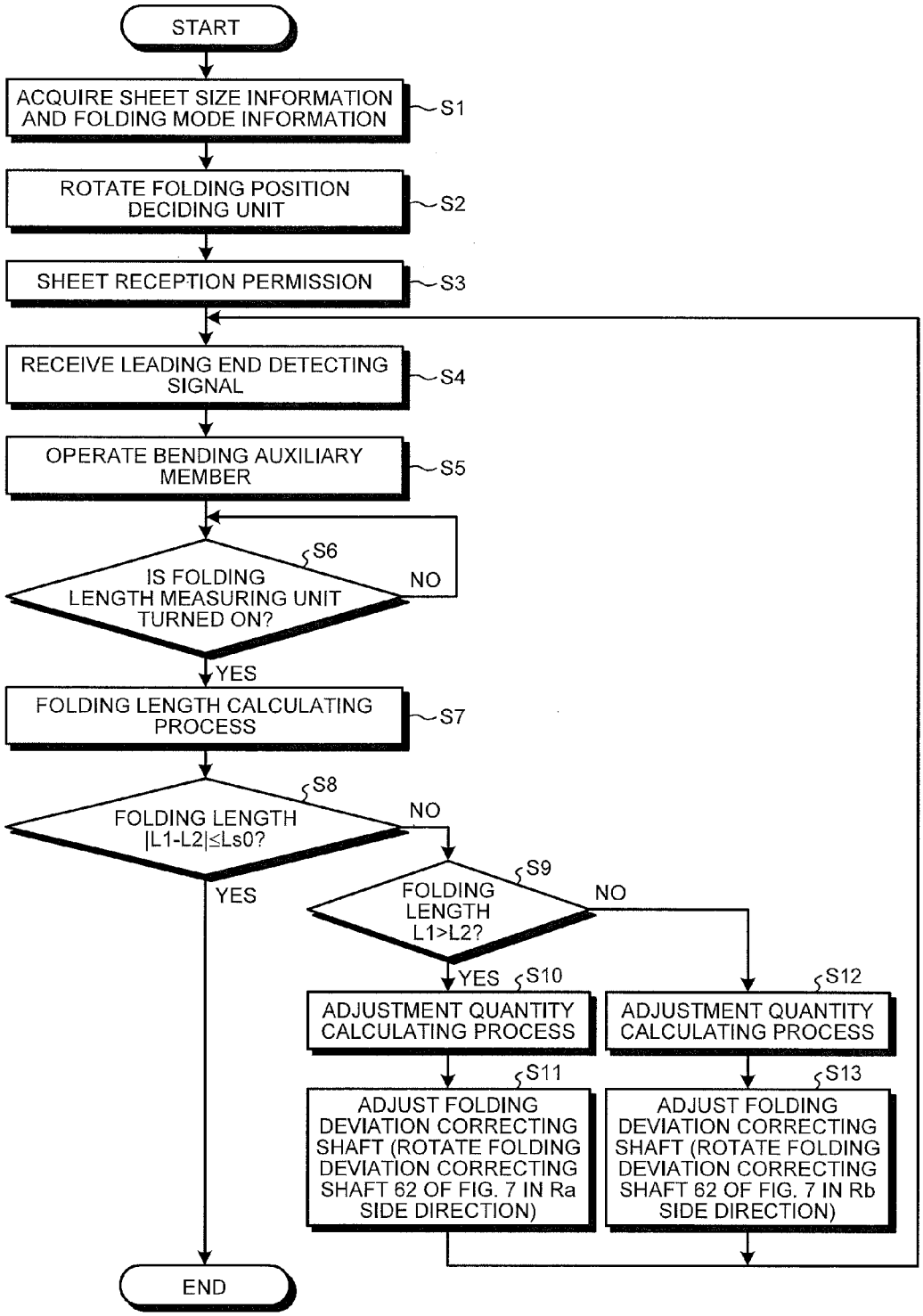
FIG. 13 is a flowchart illustrating an exemplary procedure of a method for adjusting oblique deviation in a folding position by a control unit in the control system of FIG. 11.

FIG. 13 is a flowchart illustrating an example of a procedure of a method of adjusting oblique deviation in a folding position by the control unit 101 in the control system of FIG. 11.

First, in step S1, sheet information (sheet size) and folding type (folding mode) information (single folding, triple folding, or the like) are acquired from the main body of the imaging forming apparatus 600. The folding position of the sheet is decided based on the sheet information (sheet size) and the folding mode information. In step S2, the folding position defining shaft driving unit 103 is controlled such that the folding position defining shaft 60 of the sheet position defining member 6 is rotated up to a predetermined rotational position. Thereafter, in step S3, a sheet reception permission signal is transmitted to the main body of the imaging forming apparatus 600.

When the sheet is conveyed and then a signal representing that the front edge of the sheet has been detected by the front edge detecting unit 7 is received in step S4, in step S5, the bending auxiliary member driving unit 104 is controlled using the front edge detecting signal as a trigger such that the bending auxiliary member 8 is rotated at optimum timing. The bending auxiliary member 8 is pressed to guide the sheet into the nip between the pair of folding rollers 2, and so the sheet is conveyed to the downstream side of the pair of folding rollers 2 in the conveying direction. After the sheet has passed through the pair of folding rollers 2, in step S6, the folding length measuring units 9 arranged on the processed sheet conveying path 40 are turned on when the sheet front edge (the position of the folding line) is detected.

In step S7, the control unit 101 performs a folding length calculation process using the front edge detecting signal of the folding length measuring unit 9 generated by measuring the folded sheet as a trigger. For example, the calculation process is performed to calculate a folding length L [mm] using the following Formula (2) based on a measurement result of a time T [sec] from when the front edge of the folded sheet is detected to when the tail edge of the folded sheet is detected and linear velocity V [mm/sec].

$$L=T\times V \quad (2)$$

The folding length measuring units 9 are arranged at both end portions of the processed sheet conveying path 40, through which the sheet passes, in the width direction, as illustrated in FIG. 10. The folding lengths L1 [mm] and L2 [mm] at both end portions of the processed sheet conveying path 40 are calculated based on the measurement results of the plurality of folding length measuring units 9. When a difference between calculation values of the two calculated folding lengths L1 and L2 is a specific value Ls0 or less (Yes in step S8), the process is finished.

However, when the difference between the calculation values of the folding lengths L1 and L2 is larger than the specific value Ls0 (No in step S8) and the folding length L1 is larger than the folding length L2 (Yes in step S9), in step S10, an adjustment quantity is calculated as illustrated in FIG. 12B. Then, in step S11, control is performed such that the folding deviation correcting shaft 62 of the sheet position defining member 6 illustrated in FIG. 7 is adjusted to rotate in an Ra side direction so as to increase the folding length L2 (to reduce Y). However, when the folding length L1 is smaller than the folding length L2 (No in step S9), in step S12, an adjustment quantity is calculated as illustrated in FIG. 12A. In step S13, control is performed such that the folding deviation correcting shaft 62 of the sheet position defining member 6 illustrated in FIG. 7 is adjusted to rotate in an Rb side direction in order to reduce the folding length L2 (to increase Y). The adjustment quantity process has been described above with reference to FIGS. 12A and 12B, and thus the redundant description will not be repeated.

Thereafter, reception of the next sheet is permitted, and the processes of step S4 and steps subsequent thereto are re-executed. In this control example, it is determined whether or not the difference between the folding lengths L1 and L2 is a specific value or less (step S8 in the flowchart). However, control may be performed such that it is determined whether or not each of the folding lengths L1 and L2 is a specific value or less.

Figure 14:
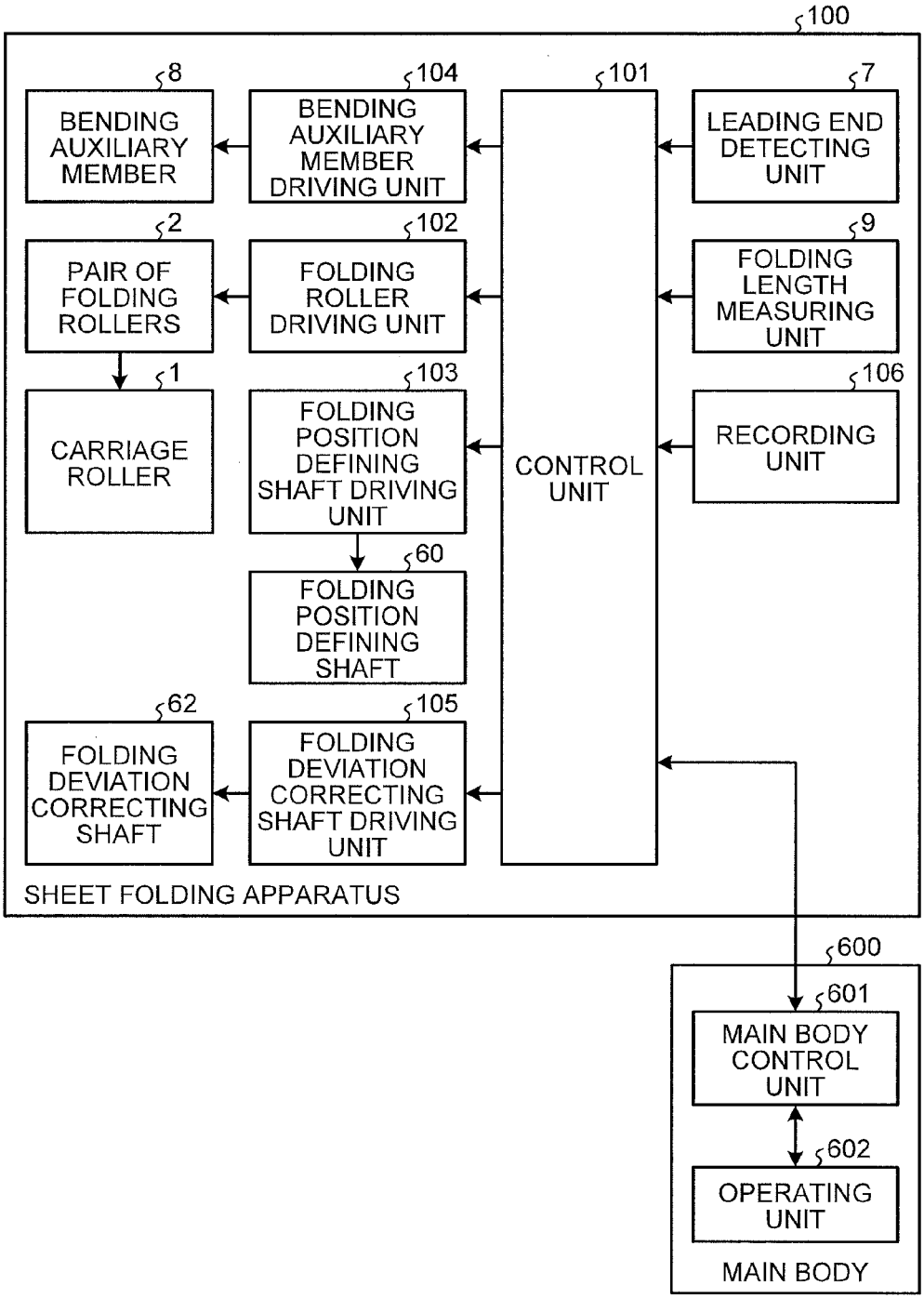
FIG. 14 is a block diagram illustrating a configuration example of a control system in a sheet folding apparatus according to another embodiment.

FIG. 14 is a block diagram illustrating a configuration example of a control system in the sheet folding apparatus according to another embodiment. The same components of FIG. 14 as in FIG. 11 are denoted by the same reference numerals, and the redundant description will not be repeated.

The control system of FIG. 14 includes a recording unit 106 functioning as a storage unit that stores correction control information in which the folding position of the sheet is associated with an inclination of the front edge of the sheet or a correction quantity of the sheet inclination correcting shaft. For example, the recording unit 106 can be configured with a storage medium such as a memory made of a semiconductor or the like, a magnetic disk, an optical disk, or the like. For example, the recording unit 106 records a folding deviation quantity representing an inclination of the front edge of the sheet according to the sheet size or the folding mode. The folding deviation quantity is written and recorded at the time of shipment from a factory. However, the folding deviation quantity may be recorded by the user at arbitrary timing as necessary. A method of recording the calculation result in steps S10 and S12 in the flowchart of FIG. 13 is preferably used as a recording method. However, there may be used a method of recording an arbitrary value which a service person or a user directly inputs through the operating unit 602 in the main body of the image forming apparatus.

Figure 15:
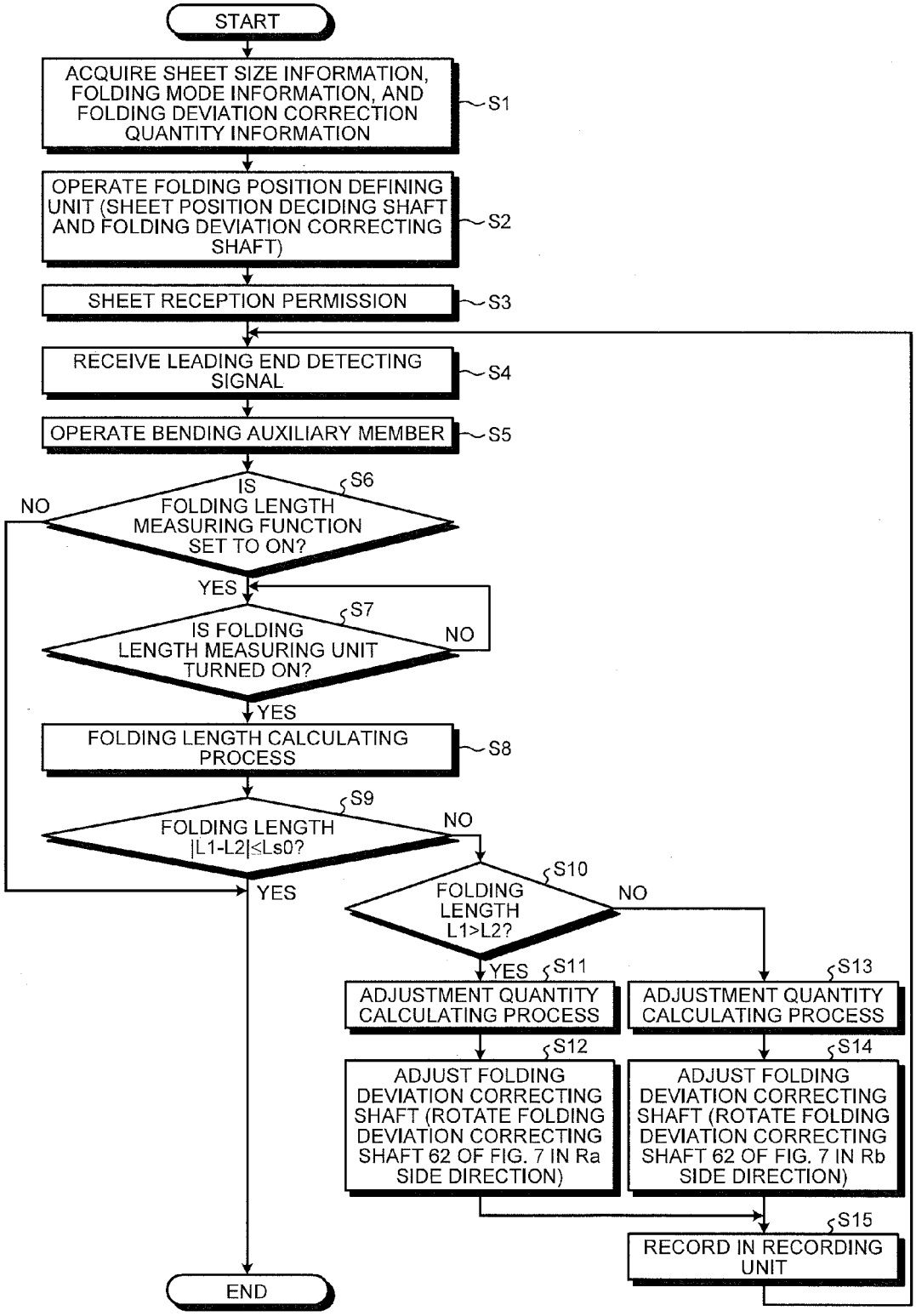
FIG. 15 is a flowchart illustrating an exemplary procedure of a method for adjusting oblique deviation in a folding position by a control unit in the control system of FIG. 14.

FIG. 15 is a flowchart illustrating an example of a procedure of a method of adjusting oblique deviation in a folding position by the control unit 101 in the control system including the recording unit 106 of FIG. 14.

First, in step S1, sheet information (sheet size) and folding mode information (single folding, triple folding, or the like) are acquired from the main body of the imaging forming apparatus 600, and folding deviation correction quantity information at that time is acquired from the recording unit 106 based on the sheet information and the folding mode information. The folding position is decided based on the sheet information (sheet size) and the folding mode information, and the folding deviation quantity is decided based on the folding deviation correction quantity information. In step S2, the folding position defining shaft 60 and the folding deviation correcting shaft 62 of the sheet position defining member 6 are operated based on the folding position information and the folding deviation quantity information. Thereafter, in step S3, a sheet reception permission signal is transmitted to the main body of the imaging forming apparatus 600.

When the sheet is conveyed and then a signal representing that the front edge of the sheet has been detected by the front edge detecting unit 7 is received in step S4, in step S5, the bending auxiliary member driving unit 104 is controlled using the front edge detecting signal as a trigger such that the bending auxiliary member 8 is rotated at optimum timing. The bending auxiliary member 8 is pressed to guide the sheet into the nip between the pair of folding rollers 2, and so the sheet is conveyed to the downstream side of the pair of folding rollers 2 in the conveying direction. After the sheet has passed through the pair of folding rollers 2, in step S7, the folding length measuring unit 9 arranged on the processed sheet conveying path 40 is turned on when the sheet front edge is detected. However, when it is determined in step S6 that a function of the folding length measuring unit 9 is previously set to OFF through the operating unit 602, the process is finished without measuring the folding length.

In step S8, the control unit 101 performs a folding length calculation process using the front edge detecting signal of the folding length measuring unit 9 generated by measuring the folded sheet as a trigger. For example, similarly to the above described example, the calculation process is performed to calculate a folding length L [mm] using the following Formula (2) based on a measurement result of a time T [sec] from when the front edge of the folded sheet is detected to when the tail edge of the folded sheet is detected and linear velocity V [mm/sec].

$$L=T\times V \tag{2}$$

The folding length measuring units 9 are arranged at both end portions of the processed sheet conveying path 40, through which the sheet passes, in the width direction, as illustrated in FIG. 10. The folding lengths L1 [mm] and L2 [mm] at both end portions of the processed sheet conveying path 40 are calculated based on the measurement results of the plurality of folding length measuring units 9. When a difference between calculation values of the two calculated folding lengths L1 and L2 is a specific value Ls0 or less (Yes in step S9), the process is finished.

However, when the difference between the calculation values of the folding lengths L1 and L2 is larger than the specific value Ls0 (No in step S9) and the folding length L1 is larger than the folding length L2 (Yes in step S10), in step S11, an adjustment quantity is calculated as illustrated in FIG. 12B. Then, in step S12, control is performed such that the folding deviation correcting shaft 62 of the sheet position defining member 6 illustrated in FIG. 7 is adjusted to rotate in an Ra side direction so as to increase the folding length L2 (to reduce Y). However, when the folding length L1 is smaller than the folding length L2 (No in step S10), in step S13, an adjustment quantity is calculated as illustrated in FIG. 12A. In step S14, control is performed such that the folding deviation correcting shaft 62 of the sheet position defining member 6 illustrated in FIG. 7 is adjusted to rotate in an Rb side direction so as to reduce the folding length L2 (to increase Y). The adjustment quantity process has been described above with reference to FIGS. 12A and 12B, and thus the redundant description will not be repeated.

Thereafter, in step S15, information (folding position decision information and folding deviation correction information) at that time is recorded in the recording unit 106. Then, reception of the next sheet is permitted, and the processes of step S4 and steps subsequent thereto are re-executed. In this control example, it is determined whether or not the difference between the folding lengths L1 and L2 is a specific value or less (step S10 in the flowchart). However, control may be performed such that it is determined whether or not each of the folding lengths L1 and L2 is a specific value or less.

Figure 16:
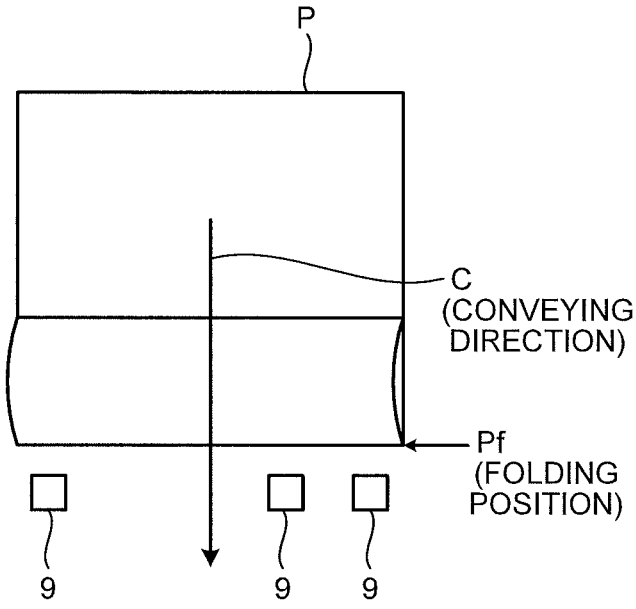
FIG. 16 is an explanatory view illustrating a relation between an arrangement position of a folding length measuring unit and a sheet according to another configuration example.
Figure 17:
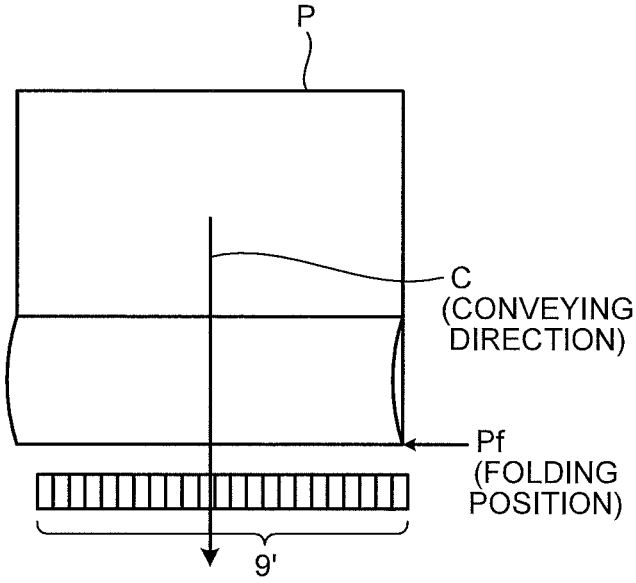
FIG. 17 is an explanatory view illustrating a relation between an arrangement position of a folding length measuring unit and a sheet according to still another configuration example.

FIGS. 16 and 17 are explanatory views illustrating a relation between an arrangement position of the folding length measuring unit 9 and the sheet P according to another configuration example.

As illustrated in FIG. 16, three folding length measuring units 9 or more are provided in the width direction perpendicular to the conveying direction of the sheet P, and thus the folding length of various sheet sizes can be accurately measured. For example, when the two folding length measuring units 9 are provided as illustrated in FIG. 10, it is necessary to arrange the folding length measuring units 9 according to the size of the sheet having the smallest width. However, in this case, it is difficult to measure the size of the sheet having a large width at both end portions, and thus the accuracy of measuring the folding deviation quantity is lowered. In this regard, the three folding length measuring units 9 are provided such that the folding length measuring units 9 are arranged at positions corresponding to the sheet width of, for example, A4 and A3 as illustrated in FIG. 16. In the example of FIG. 16, it is assumed that each of the folding length measuring units 9 is implemented using a single photosensor. However, the folding length measuring unit 9 may be implemented using a linear imaging element 9' such as a contact image sensor (CIS) instead of a single photosensor as illustrated in FIG. 17. In this case, a more accurate measurement can be made.

Figure 18:
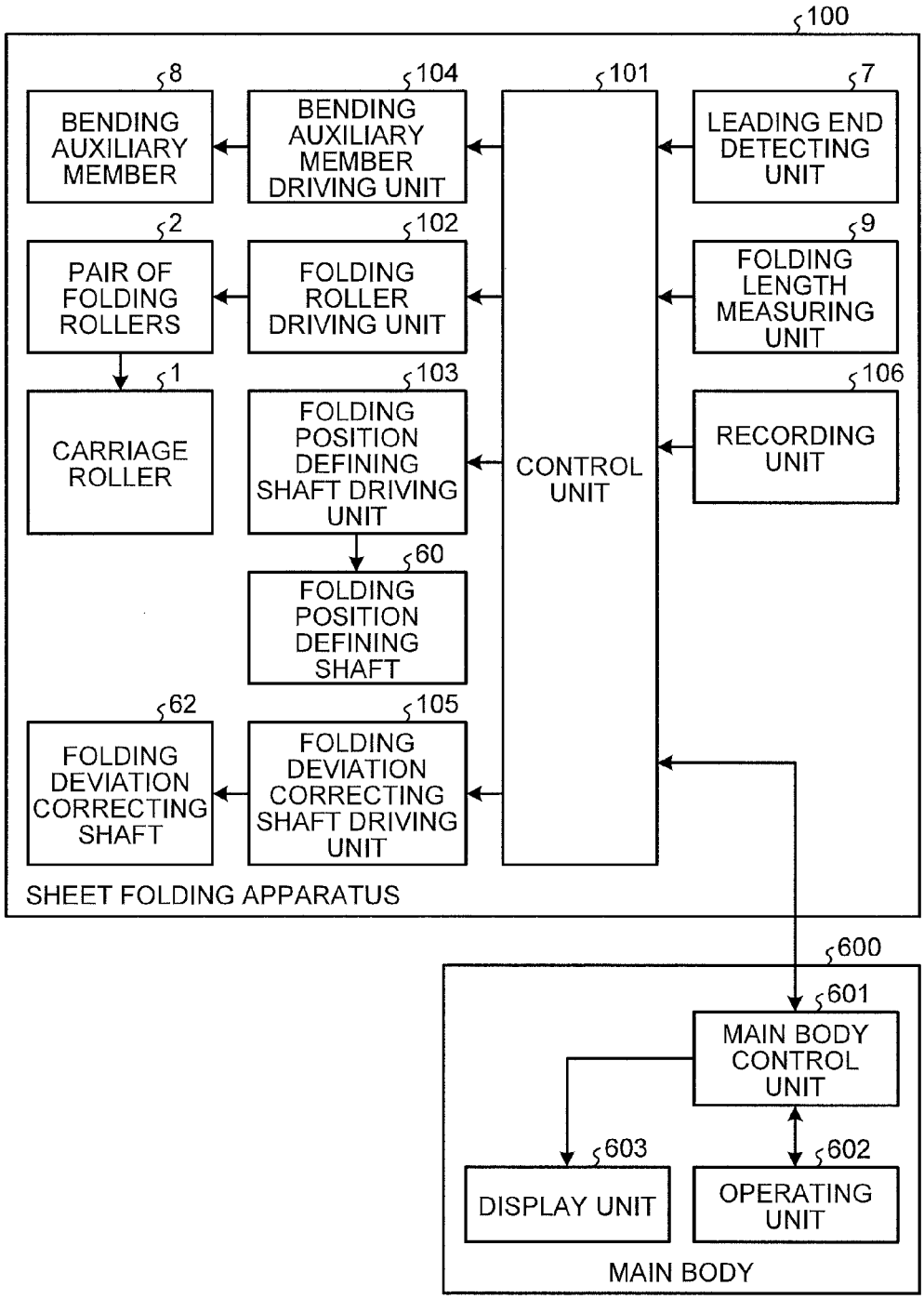
FIG. 18 is a block diagram illustrating a configuration example of a control system in a sheet folding apparatus according to still another embodiment.

FIG. 18 is a block diagram illustrating a configuration example of a control system in the sheet folding apparatus according to still another embodiment. The same components of FIG. 18 as in FIGS. 11 and 14 are denoted by the same reference numerals, and the redundant description will not be repeated.

In the control system of FIG. 18, a display unit 603 functioning as a display unit that displays a measurement result of the folding length measuring unit is arranged at the main body side of the imaging forming apparatus 600. The display unit may be arranged at the sheet folding apparatus 100 side other than the main body of the imaging forming apparatus 600.

Figure 19:
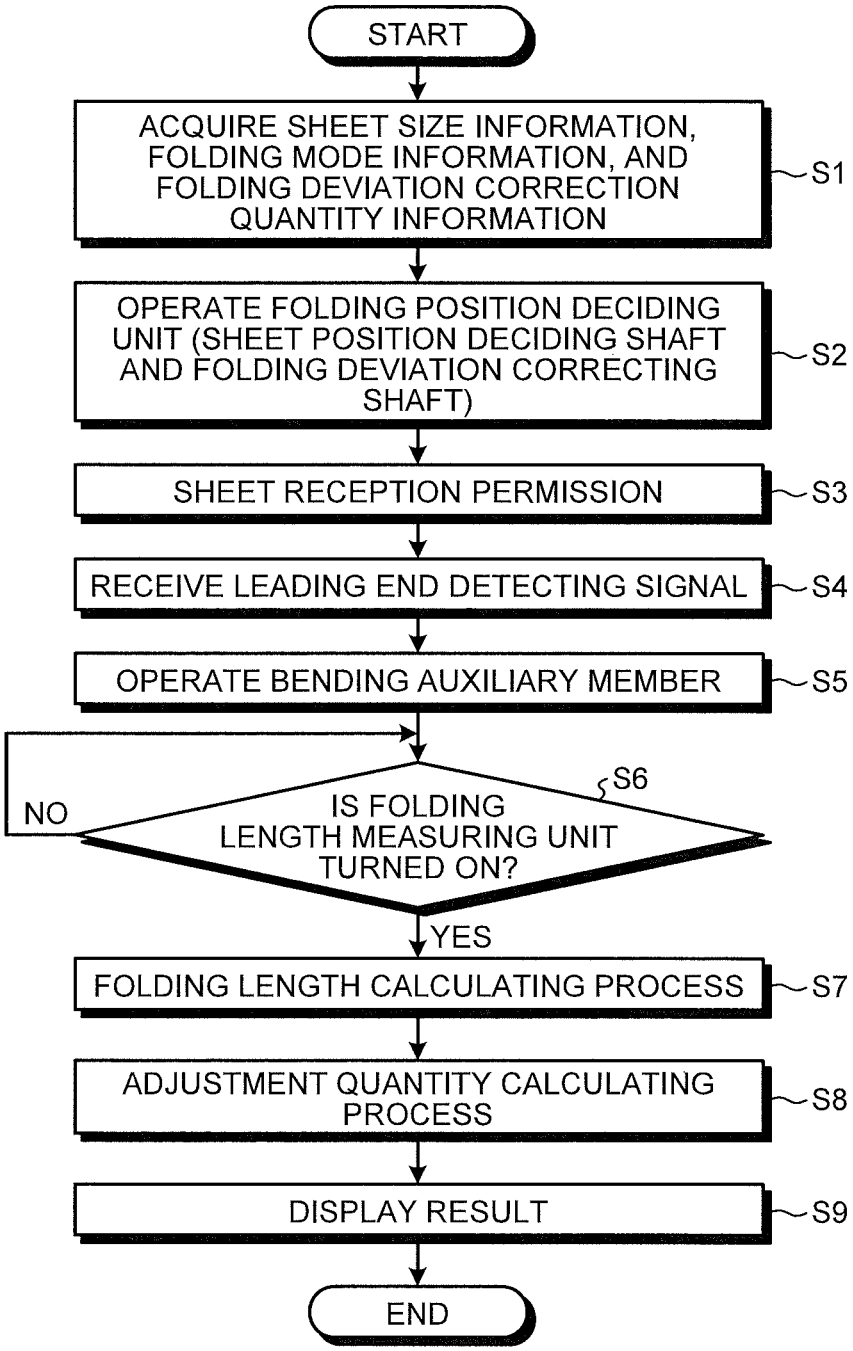
FIG. 19 is a flowchart illustrating an example of a procedure of a method of adjusting oblique deviation in a folding position by a control unit in the control system of FIG. 18.

FIG. 19 is a flowchart illustrating an example of a procedure of a method of adjusting oblique deviation in a folding position by the control unit 101 in the control system including the display unit 603 of FIG. 18. In the flowchart of FIG. 19, the process from steps S1 to S7 are the same as in FIG. 13, and thus the redundant description will not be repeated.

Referring to the flowchart of FIG. 19, after the folding length calculating process is performed in step S7, in step S8, the control unit 101 operates as an adjustment quantity calculating unit and calculates an adjustment quantity of the sheet position defining member 6. In step S9, the control unit 101 transmits the calculation result to the main body side of the imaging forming apparatus 600, so that the calculation result is displayed on the display unit 603. For example, the contents of the calculation result displayed on the display unit 603 include the folding position deciding position (the rotational position of the folding position defining shaft 60) of the sheet position defining member 6 and the folding deviation quantity at that time. A numerical value or a direction when the user actually makes fine adjustment using the operating unit 602 as necessary may be calculated and displayed as necessary.

According to the present embodiment, the sheet conveying path 50 is formed by the conveying path forming member 5 such that a portion through which at least the front edge of the sheet at the downstream side in the conveying direction passes is curved. Since the sheet conveying path 50 includes the curved portion, the space in the sheet folding apparatus 100 can be reduced compared to when the sheet conveying path is formed such that the sheet P is linearly conveyed. In addition, when the position of the folding line of the sheet is changed according to the sheet size, the folding type, or the like, the inclination of the front edge of the sheet P in the curved portion of the sheet conveying path 50 is adjusted by the sheeting position deciding unit configured with the sheet position defining member 6 or the like, and thus the oblique deviation of the folding line of the sheet P can be corrected. Thus, the space in the apparatus can be reduced, and even when the position of the folding line of the sheet P is changed according to the sheet size, the folding type, or the like, the oblique deviation of the folding line can be corrected.

Further, according to the present embodiment, the sheet position defining member 6 includes the abutting member 61 on which the front edge of the sheet P abuts on, the abutting position deciding shaft 60 that rotates the abutting member 61 to change the abutting position of the front edge of the sheet P in the curved portion of the sheet conveying path 50, and the sheet inclination correcting shaft 62 that rotates the abutting member 61 to change the inclination of the front edge of the sheet P in the width direction intersecting the sheet conveying direction of the sheet conveying path 50 formed to intersect the abutting position deciding shaft 60. The two-shaft structure of the abutting position deciding shaft 60 and the sheet inclination correcting shaft 62 is employed. Thus, the position of the folding line of the sheet P can be decided by adjusting the abutting position deciding shaft 60 of the sheet position defining member 6, and the oblique deviation of the folding line can be reliably corrected by adjusting the folding deviation correcting shaft 62 functioning as the sheet inclination correcting shaft.

Further, according to the present embodiment, provided are the folding deviation correcting shaft driving unit 105 that rotatably drives the folding deviation correcting shaft 62 of the sheet position defining member 6 and the control unit 101 functioning as the control unit that controls the folding deviation correcting shaft driving unit 105. Through the above configuration, even though the folding position of the sheet P changes, since the folding deviation correcting shaft 62 of the sheet position defining member 6 can be adjusted according to the folding position, the oblique deviation of the folding line can be reliably corrected regardless of the sheet size or the folding type.

Further, according to the present embodiment, the folding length measuring units 9 that measure the spatial length or the transit time between the folding line of the sheet P and the end edge of the sheet P in the conveying direction are arranged at a plurality of positions on the processed sheet conveying path 40, through which the sheet P having the folding line formed thereon is conveyed, in the width direction intersecting the sheet conveying direction. The control unit 101 controls the folding deviation correcting shaft driving unit 105 based on the measurement results of the folding length measuring units 9. Through this control, the oblique deviation of the sheet can be adjusted without time and effort of measuring the length of the oblique deviation and manually adjusting the oblique deviation by human.

Further, according to the invention, the folding length measuring units 9 are provided on two or more different positions on the processed sheet conveying path 40 in the width direction intersecting the sheet conveying direction. Thus, the oblique deviation of the folding line can be reliably corrected on a plurality of kinds of sheets having different sizes in the width direction. Particularly, even when the width size of the sheet is large, the oblique deviation of the sheet can be reliably corrected with a high degree of accuracy.

Further, according to the invention, arranged is the display unit 603 functioning as the display unit that displays the measurement result of the folding length measuring unit 9. Thus, the user can easily adjust an inclination while seeing the display.

Further, according to the invention, arranged is the recording unit 106 functioning as the storage unit that stores the correction control information in which the folding position of the sheet P is associated with the inclination of the front edge of the sheet P or the correction quantity (folding deviation correction quantity) of the folding deviation correcting shaft 62 functioning as the sheet inclination correcting shaft. The control unit 101 performs control based on the correction control information such that the inclination of the front edge of the sheet P is changed according to the folding position of the sheet P. In this case, since it is unnecessary to measure the folding deviation quantity each time, a load of the control unit 101 can be reduced.

Further, according to the invention, arranged are the imaging forming apparatus 600 functioning as the image forming unit that forms the image on the sheet and the sheet folding apparatus 100 of the above configuration which is an image forming system including the sheet processing unit of performing the folding process on the sheet and that functions as the sheet processing unit. A series of processes from a process of forming an image on the sheet P to a folding process of forming a folding line at a predetermined position of the sheet P on which the image is formed can be performed through this image forming system. Thus, the space in the sheet folding apparatus can be reduced, and the whole image forming system can be scaled down. Further, even when the position of the folding line of the sheet P changes according to the sheet size, the folding type, or the like, the oblique deviation of the folding line can be corrected.

According to the embodiments of the invention, a sheet conveying path is formed by a conveying path forming member such that a portion, through which at least a front edge of a sheet at a downstream side in a conveying direction passes, is curved. Since the sheet conveying path includes the curved portion, an inner space of a sheet folding apparatus can be reduced compared to the case where a sheet conveying path is formed such that a sheet is linearly conveyed. In addition, when an inclination of the front edge of the sheet in the curved portion of the sheet conveying path is adjusted by the sheet position defining unit so that the position of a folding line of a sheet can be changed depending on the sheet size, the folding type, or the like, the oblique deviation of the folding line of the sheet can be corrected. Thus, according to the embodiments of the invention, an inner space of an apparatus can be reduced. Moreover, even when the position of the folding line of the sheet is changed according to the sheet size, the folding type, or the like, the oblique deviation of the folding line can be corrected.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus capable of folding a sheet along a folding line, comprising:

a conveying path forming member that forms a sheet conveying path having a curved portion through which a front edge of the sheet passes at a downstream side at least of a sheet conveying direction;

a sheet conveying unit that conveys the sheet along the sheet conveying path;

a sheet folding unit that folds the sheet along the folding line in the sheet conveying path, and then conveys the sheet toward a discharge direction with the folding line discharged first as a front edge; and a sheet position defining unit that defines a position of the front edge of the sheet at the downstream side of the sheet conveying direction in the curved portion of the sheet conveying path so that a target position of the folding line on the sheet coincides with a folding position of the sheet folding unit, wherein the sheet position defining unit is configured to be capable of adjusting an inclination of the front edge of the sheet in the curved portion of the sheet conveying path, and wherein the sheet position defining unit includes:

an abutting member that abuts on the front edge of the sheet;

an abutting position defining shaft that makes the abutting member rotatable so as to change the abutting position with the front edge of the sheet in the curved portion of the sheet conveying path; and a sheet inclination correcting shaft that is disposed so as to intersect with the abutting position defining shaft, and makes the abutting member rotatable so as to change an inclination of the front edge of the sheet in a width direction which intersects with the sheet conveying direction in the sheet conveying path.

2. The sheet processing apparatus according to claim 1, further comprising:

a driving unit that rotationally drives the sheet inclination correcting shaft; and a control unit that controls the driving unit.

3. The sheet processing apparatus according to claim 2, further comprising:

a measuring unit that measures a spatial length or a transit time between the folding line on the sheet and a tail edge of the sheet in a sheet conveying direction at a plurality of points in a width direction which intersects with the sheet conveying direction in a processed-sheet conveying path through which the sheet on which the folding line is made by the sheet folding unit is conveyed, wherein the control unit controls the driving unit on the basis of a result of the measurement by the measuring unit.

4. The sheet processing apparatus according to claim 3, wherein two or more measuring units are disposed at positions different from each other in the width direction which intersects with the sheet conveying direction in the processed-sheet conveying path.

5. The sheet processing apparatus according to claim 3, further comprising:

a display unit that displays a result of the measurement by the measuring unit.

6. The sheet processing apparatus according to claim 2, further comprising:

a storage unit that stores correction control information in which a folding position on the sheets is associated with an inclination of the front edge of the sheet or a correction amount of the sheet inclination correcting shaft, wherein the control unit controls the driving unit so as to change the inclination of the front edge of the sheet, depending on the folding position on the sheet, on the basis of the correction control information.

7. An image forming system comprising:

an image forming apparatus that forms an image on a sheet; and a sheet processing apparatus capable of folding the sheet along a folding line, wherein the sheet processing apparatus includes:

a conveying path forming member that forms a sheet conveying path having a curved portion through which a front edge of the sheet passes at a downstream side at least in a sheet conveying direction;

a sheet conveying unit that conveys the sheet along the sheet conveying path;

a sheet folding unit that folds the sheet along the folding line in the sheet conveying path, and then conveys the sheet toward a discharge direction with the folding line discharged first as a front edge; and a sheet position defining unit that defines a position of the front edge of the sheet at the downstream side of the sheet conveying direction in the curved portion of the sheet conveying path so that a target position of the folding line on the sheet coincides with a folding position of the sheet folding unit, wherein the sheet position defining unit is configured to be capable of adjusting an inclination of the front edge of the sheet in the curved portion of the sheet conveying path, and wherein the sheet position defining unit includes:

an abutting member that abuts on the front edge of the sheet;

an abutting position defining shaft that makes the abutting member rotatable so as to change the abutting position with the front edge of the sheet in the curved portion of the sheet conveying path; and a sheet inclination correcting shaft that is disposed so as to intersect with the abutting position defining shaft, and makes the abutting member rotatable so as to change an inclination of the front edge of the sheet in a width direction which intersects with the sheet conveying direction in the sheet conveying path.

8. The sheet processing apparatus according to claim 7, further comprising:

a driving unit that rotationally drives the sheet inclination correcting shaft; and a control unit that controls the driving unit.

9. The sheet processing apparatus according to claim 8, further comprising:

a measuring unit that measures a spatial length or a transit time between the folding line on the sheet and a tail edge of the sheet in a sheet conveying direction at a plurality of points in a width direction which intersects with the sheet conveying direction in a processed-sheet conveying path through which the sheet on which the folding line is made by the sheet folding unit is conveyed, wherein the control unit controls the driving unit on the basis of a result of the measurement by the measuring unit.

10. The sheet processing apparatus according to claim 9, wherein two or more measuring units are disposed at positions different from each other in the width direction which intersects with the sheet conveying direction in the processed-sheet conveying path.

11. The sheet processing apparatus according to claim 9, further comprising:

a display unit that displays a result of the measurement by the measuring unit.

12. The sheet processing apparatus according to claim 8, further comprising:

a storage unit that stores correction control information in which a folding position on the sheets is associated with an inclination of the front edge of the sheet or a correction amount of the sheet inclination correcting shaft, wherein the control unit controls the driving unit so as to change the inclination of the front edge of the sheet, depending on the folding position on the sheet, on the basis of the correction control information.

* * * * *